US010008807B2

(12) United States Patent
Cayzac

(10) Patent No.: US 10,008,807 B2
(45) Date of Patent: Jun. 26, 2018

(54) LEVER-TYPE CONNECTOR AND PRINTED CIRCUIT BOARD EQUIPPED WITH SUCH CONNECTORS

(71) Applicant: Amphenol Air LB, Carignan (FR)

(72) Inventor: Gaspard Cayzac, Margut (FR)

(73) Assignee: Amphenol Air LB, Carignan (FR)

( * ) Notice: Subject to any disclaimer, the term of this patent is extended or adjusted under 35 U.S.C. 154(b) by 0 days. days.

(21) Appl. No.: 15/498,090

(22) Filed: Apr. 26, 2017

(65) Prior Publication Data

US 2017/0310046 A1 Oct. 26, 2017

(30) Foreign Application Priority Data

Apr. 26, 2016 (FR) ..... 16 53681

(51) Int. Cl.
*H01R 13/629* (2006.01)
*H01R 12/71* (2011.01)

(52) U.S. Cl.
CPC ..... *H01R 13/62994* (2013.01); *H01R 12/716* (2013.01)

(58) Field of Classification Search
CPC ..... H01R 12/721; H01R 13/62933; H01R 13/62977; H01R 13/639; H01R 12/716; H01R 12/85; H01R 12/89; H01R 13/005; H01R 13/193; H01R 13/4534; H01R 13/4538; H01R 13/506; H01R 13/514; H01R 13/6272
See application file for complete search history.

(56) References Cited

U.S. PATENT DOCUMENTS 5,474,462 A * 12/1995 Yamanashi ..... H01R 13/62933 439/153
5,873,745 A * 2/1999 Duclos ..... H01R 13/62944 439/157
6,142,800 A * 11/2000 Iwahori ..... H01R 13/62977 439/152
6,146,161 A * 11/2000 Osawa ..... H01R 13/62938 439/140
6,213,795 B1 * 4/2001 Drescher ..... H01R 13/62977 439/152
7,361,036 B2 * 4/2008 Pittenger ..... H01R 13/62955 439/157
7,938,655 B2 * 5/2011 Komiyama ..... H01R 13/62977 439/157
7,959,452 B2 * 6/2011 Komiyama ..... H01R 13/62977 439/157
2002/0001985 A1 * 1/2002 Saito ..... H01R 13/62905 439/246

(Continued)

*Primary Examiner* — Truc Nguyen
(74) *Attorney, Agent, or Firm* — Christensen O'Connor Johnson Kindness PLLC; Llewellyn Lawson; Andrew Laughlin

(57) ABSTRACT

This lever-type connector comprises a first part forming a base and a second part mobile in relation to the base, the first and second parts inwardly receiving first and second contact assemblies facing one another, male and female respectfully, each provided at one end with conductors to be connected, and a cam mechanism able to move the mobile part between contact disconnection and connection positions. The cam mechanism includes a lever shaped so as to be circumscribed inside the main cross-section of the connector.

10 Claims, 9 Drawing Sheets

(56) References Cited

U.S. PATENT DOCUMENTS

| | | | | |
|---|---|---|---|---|
| 2006/0172602 | A1* | 8/2006 | Sakakura | H01R 9/032 439/607.52 |
| 2010/0159734 | A1* | 6/2010 | Horiuchi | H01R 13/514 439/374 |
| 2014/0248788 | A1* | 9/2014 | Kodama | H01R 13/62938 439/310 |
| 2015/0064953 | A1* | 3/2015 | Iwatani | H01R 13/62933 439/341 |
| 2015/0171547 | A1* | 6/2015 | Toyoda | H01R 13/567 439/460 |

* cited by examiner

LEVER-TYPE CONNECTOR AND PRINTED CIRCUIT BOARD EQUIPPED WITH SUCH CONNECTORS

The present invention relates generally to connectors, and more particularly to lever-type connectors for the electrical connection and mechanical fastening of conductors.

In a particularly interesting application, the invention relates to a lever-type connector used to electrically connect contacts provided at one of the ends of a bundle of conductors to be connected.

The connectors of this type are generally made in two parts, each of which comprises, internally, male and female connection contacts respectively, provided at the ends with conductors to be connected.

When the connection is made, the two parts of the connector are engaged with one another so as to couple the male and female contacts and to thereby connect the conductors.

The lever-type connector proves to be advantageous when the density of the contacts of a connector bundle increases, making it difficult or even impossible to manually connect the two parts of the connector.

The connectors in the state of the art comprise two levers that are pivotably mounted on either side of the body of one of the parts of the connector and which cooperate with the body of the other part to ensure their displacement relative to one another.

The two levers are generally joined by their free end, thereby making their orientation impossible along the general axis of the connector, which coincides with the coupling direction of the two parts of the connector, owing to the presence of connectors in this zone so that in at least one of the connection and disconnection positions of the connector, the levers extend beyond the overall dimensions of the connector, i.e. beyond the main cross-section of the connector.

Such connectors are, however, intended to be mounted on a circuit that can include a plurality of printed circuit boards (PCB), which include a plurality of connectors that are located in close proximity or even in contact with each other, so that it is not possible, in this case, to use lever-type connectors.

The purpose of the invention is therefore to overcome these drawbacks and to provide a lever-type connector of reduced overall dimensions.

The purpose of the invention is thus a lever-type connector, comprising a first part forming a base and a second part mobile in relation to the base, the first and the second part inwardly receiving the first and second set of contacts facing one another, male and female respectively, each provided at one end with conductors to be connected, and a cam mechanism adapted to move the mobile part between disconnection and connection positions of the sets of connectors, notably between a first complete disconnection position of the contact assemblies and a second active electrical connection position of the contact assemblies.

The cam mechanism includes a lever shaped so as to be circumscribed inside the main cross-section of the connector.

Thus, regardless of the position of the lever, it does not extend laterally beyond the perimeter of the connector so that it can be handled when in contact laterally with another element of a PCB on which it is mounted.

In an embodiment, the lever comprises a plate pivotally mounted on the outer surface of a first lateral face of one of the first and second portions of the connector and having at least one slot into which a pin engages, extending laterally from a lateral wall of the other part of the connector, and a stem extending from the plate, the stem not extending laterally beyond the perimeter of the connector in the first position of the lever.

For example, the lever is pivotally mounted on the outer surface of one of lateral faces of the mobile part and the pin extends laterally from the inner surface of the lateral wall of the base, so that when the mobile part is inserted into the base, the lever is inserted between the mobile part and the base.

Advantageously, the stem extends perpendicularly to the slot and in the coupling direction when the lever is in the second position.

Advantageously, the lever has a second plate pivotally mounted on a second lateral face of one of the first and second parts of the connector and comprising at least one slot into which engages a pin, provided on a second lateral face of the other part of the connector, the second plate being linked to the stem.

For example, the lever has a second plate pivotally mounted on a second lateral outer face of the mobile part and comprising a slot in which a pin, provided on a second lateral inner face of the base, engages, the second plate being linked to the stem.

This plate can also be equipped with a second actuator stem extending, for example, from the second plate.

Advantageously, the or each plate is mounted on the mobile part and the or each pin extends from a lateral wall of the base.

In a method of implementing the invention, the or each plate has a single lateral slot.

Alternatively, provision may also be made such that the or each plate has two lateral slots, both being able to absorb the connection forces between the base and the mobile part. The second slot associated with the first slot ensures rectilinear movement of the second mobile part or plug in relation to the coupling axis.

For example, each lateral slot has an end provided with localised constriction for blocking a pin in a connection position of the plugs.

For example, the first slot is curved and second slot is straight, the two slots extending in two substantially perpendicular directions.

Advantageously, the cam mechanism is mounted between the lateral faces opposite the plate and of the mobile part.

Advantageously, the first and second parts are metallised.

The invention also relates to, according to a second aspect, a printed circuit board comprising a set of lever-type connectors as defined above.

Other objects, characteristics and advantages of the invention will become more apparent from the following description, given solely as a non-limiting example and with reference to the accompanying drawings, wherein:

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
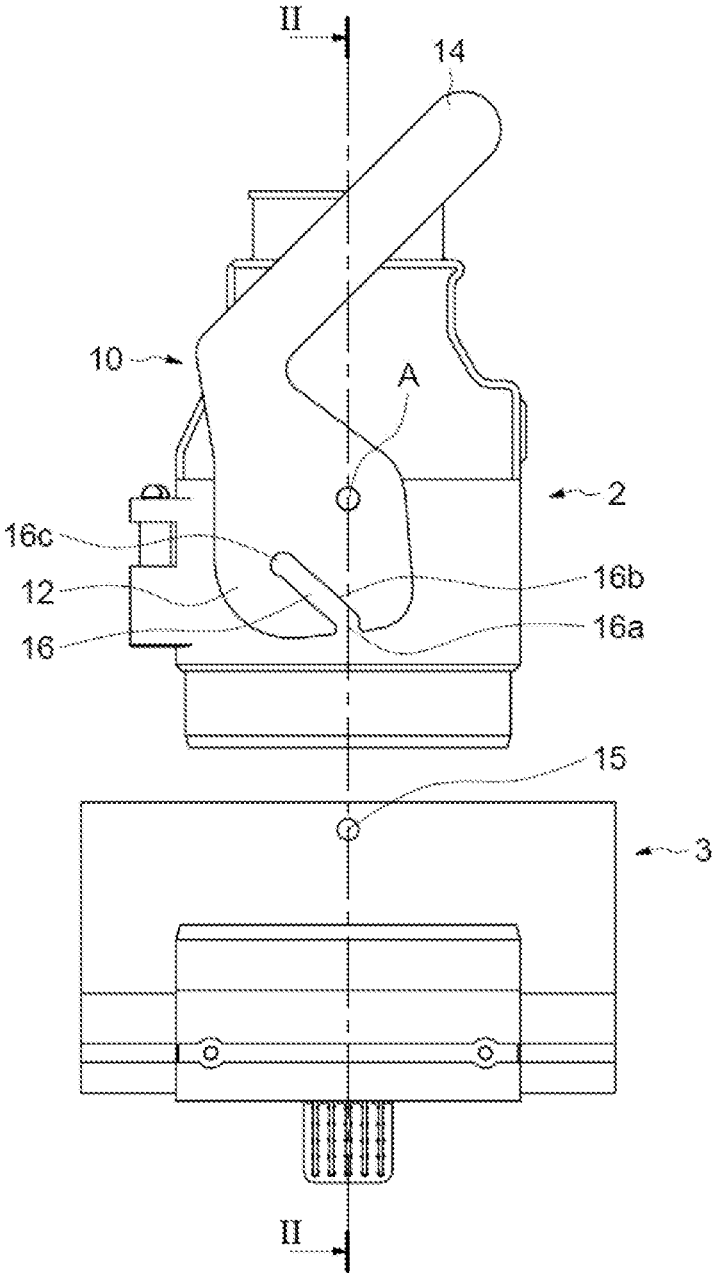
FIG. 1 is a side view of a connector according to the invention, in uncoupling position of the two connector parts.
Figure 2:
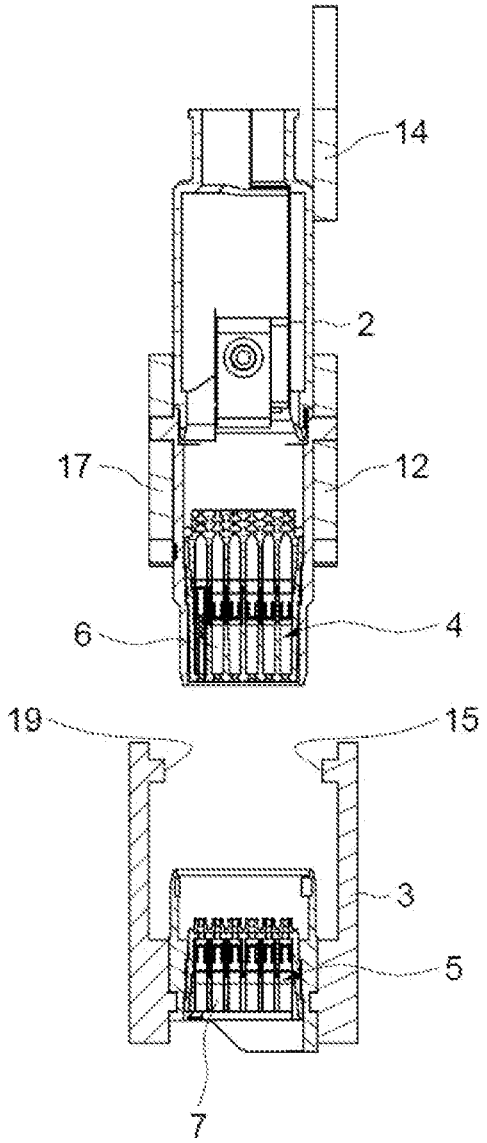
FIG. 2 is a cross-sectional view along line II-II of FIG. 1.
Figure 3:
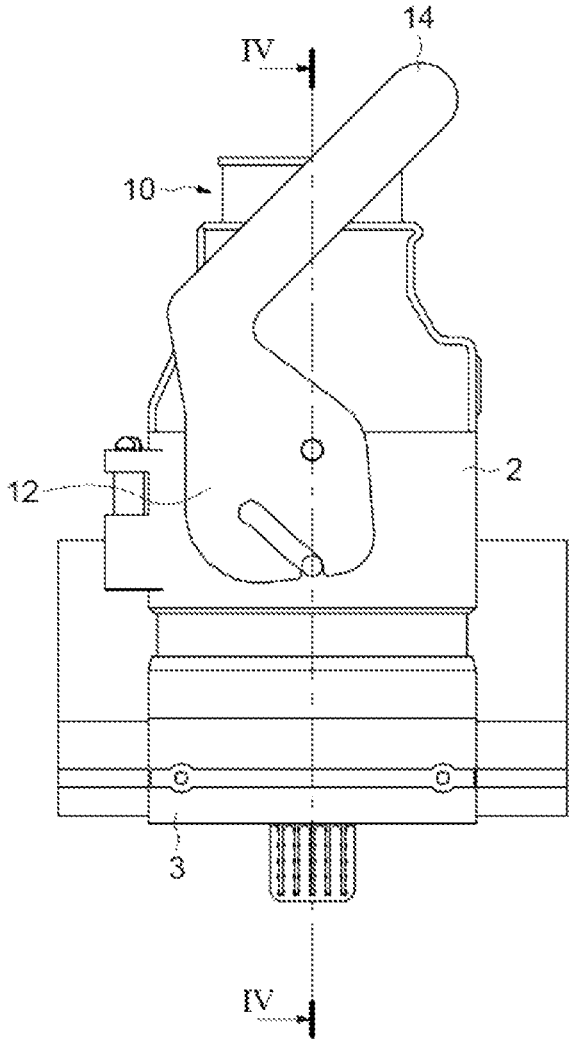
FIG. 3 is a side view of the connector of FIG. 1, in coupling position of the two parts of the connector.
Figure 4:
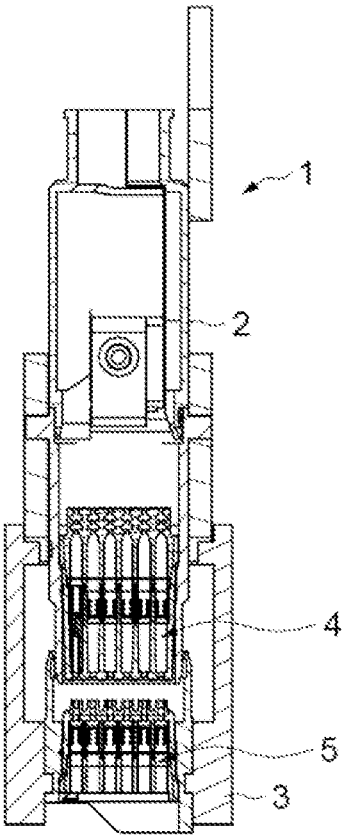
FIG. 4 is a cross-sectional view along line IV-IV of FIG. 3.
Figure 5:
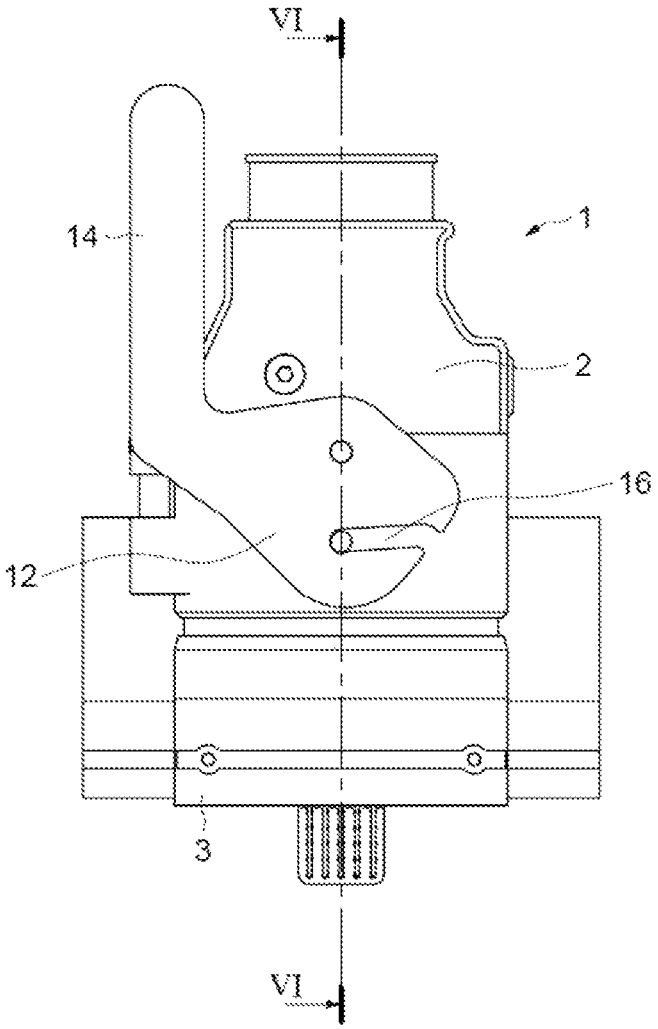
FIG. 5 shows the connector of FIG. 1, after actuation of the lever.

While illustrative embodiments have been illustrated and described, it will be appreciated that various changes can be made therein without departing from the spirit and scope of the invention.

Reference is first made to FIGS. 1 to 6 which illustrate a first embodiment of a connector according to the invention, designated by the general numerical reference 1.

This connector is intended to connect a bundle of conductors, each equipped with a contact, male or female, at one end to be connected.

In a method of implementing the invention, such connectors are intended to be mounted on printed circuit boards and are used to connect bundles of conductors of an electrical network of an aircraft conveying data or a power supply current.

As one can see, the connector 1 has two parts 2 and 3, each comprising a hollow body made of plastic material, here generally parallelepiped, internally comprising an insulating housing 4 and 5 also produced by moulding of a plastic material and providing the cells, such as 6 and 7, wherein are placed the male or female contacts.

One of the parts of the connector, namely the part referenced 3, consists of a fixed base, which mounts on a printed circuit board, for example, while the other part 2 consists of a mobile part which fits into the base 3 to connect the contacts inserted into the insulating housings 4 and 5.

As indicated above, when the density of the contacts is high, it becomes difficult or even impossible to connect them manually. Depending on the applications, the number of contacts can reach or exceed 90 such that a manual force is then insufficient to connect them.

To offset this drawback, the connector is equipped with a cam mechanism that ensures the relative displacement of the two parts of the connector.

As can be seen in the embodiment of FIGS. 1 to 7, this mechanism includes a lever 10 comprising plate 12 pivotally mounted on one of the lateral faces of the mobile part 2 and a stem 14 extending radially from the plate 12 and manually moved to cause the plate 12 to pivot about a transverse axis A.

The base 3 has a pin 15 provided on one of its corresponding lateral faces and which engages into a slot 16 provided in plate 12. The slot 16 has a first radial portion 16*a*, extending opposite the pin 15, a second inclined portion 16*b* which ensures the actual connection of the male and female contacts and an end part 16*c* connected to the middle part 16*b* by a localised cross-sectional constriction so as to block the pin in this end part 16*c* which corresponds to a connection position of the contacts.

It should be noted that the lever 10 is pivotally mounted on the outer surface of one of lateral faces of the mobile part. When the mobile part is inserted into the base, the lever is inserted between the mobile part and base, the pin 15 extending laterally from the inner surface of the lateral wall of the base.

To connect the contacts housed in the two parts of the connector, the two parts 2 and 3 (FIGS. 3 and 4) are fitted together until the pin 15 engages the first part 16*a* of the slot 16. The lever 10 is then actuated by manipulating the stem 14 so that the pin moves from the first portion 16*a* of the slot to the third portion 16*c*, so as to cause the successive movement of the mobile part 2 into the base 3 until the male and female contacts connect.

The lever can also be moved to ensure disconnection of the contacts.

Figure 6:
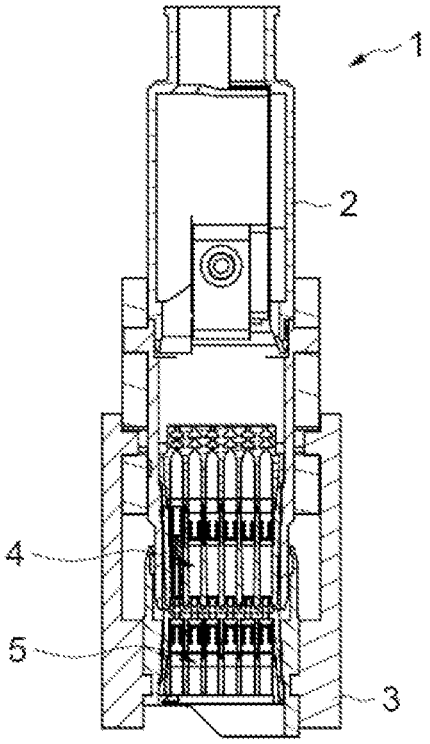
FIG. 6 is a cross-sectional view along line VI-VI of FIG. 5.

It can travel approximately 45° between a first position corresponding to complete disconnection of the contacts, visible in FIGS. 1 to 4, and a second active electrical connection position of the contacts illustrated in FIG. 6.

As one can see, in the first position, the slot 16 extends in a general direction forming a 45° angle in relation to the coupling direction of the connector.

Furthermore, the cam mechanism is configured so that it remains inscribed within the main cross-section of the connector, the stem 14 remaining permanently circumscribed within the outer perimeter of the connector.

For this purpose, the stem 14 extends perpendicularly to the slot 16. In the connecting position of the male and female contacts, the stem 14 thus extends generally in the coupling direction of the connector. In addition, its length is chosen so that it does not extend laterally beyond the perimeter of the connector in the first disconnection position of the contacts.

Furthermore, by providing a single lever pivotally mounted on one of the lateral faces of the mobile part, the cam mechanism is prevented from abutting against the conductors to be connected.

Figure 7:
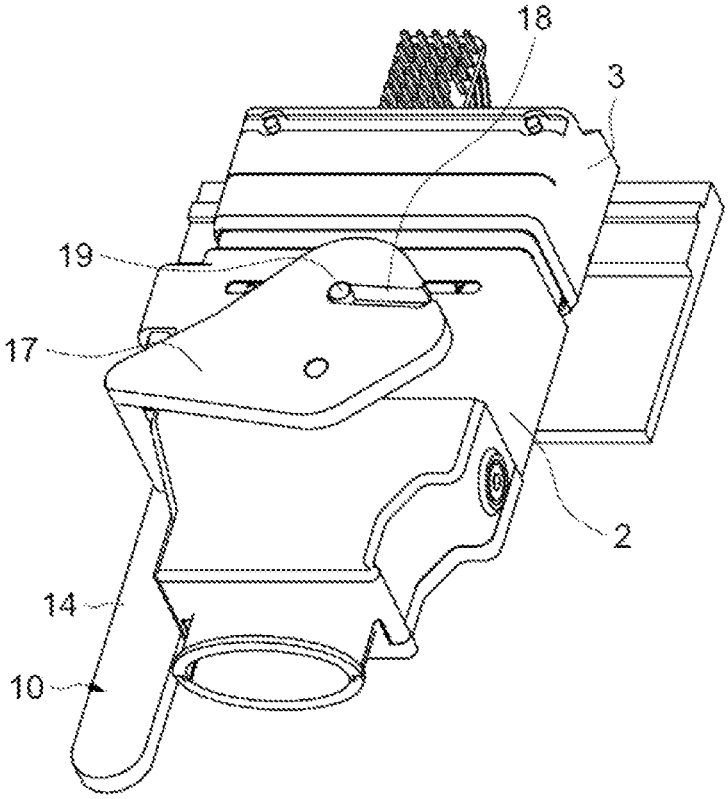
FIG. 7 illustrates another view of the connector according to the invention.

In an advantageous embodiment, particularly visible in FIG. 7, the cam mechanism has a first plate 17 similar to the plate 12 previously described with reference to FIG. 1 and related to the lever 10.

Here, this second plate 17 is pivotally mounted on a second face of the mobile part 2 opposite the first face on which the first plate 12 pivots. This second plate 17 also includes a slot 18 identical to slot 16 described previously and in which a pin 19, provided on the corresponding lateral face of the base 3, engages.

Finally, it should be noted that the invention is not limited to the embodiment which has been described.

Figure 8:
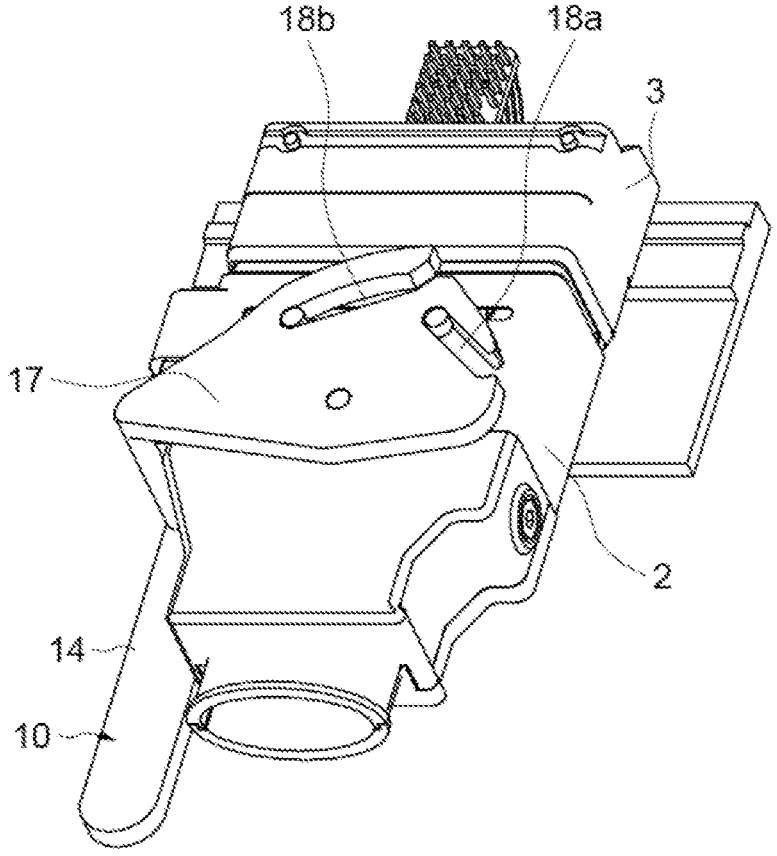
FIG. 8 illustrates another embodiment of the connector of FIGS. 1 to 7.

In the embodiment described above in reference to FIGS. 1 to 7, the or each base has a single slot in which a pin, carried by the base, engages. It is also possible, according to another embodiment shown in FIG. 8, to provide two slots in each base in which two pins, provided on a corresponding face of the base 3, respectively engage. In this regard, one can use a first slot 18*a* and 18*b*, one rectilinear and the other curved. The two slots extend in two substantially perpendicular directions, and both allow the connection forces between the base and the mobile part to be absorbed.

Figure 9:
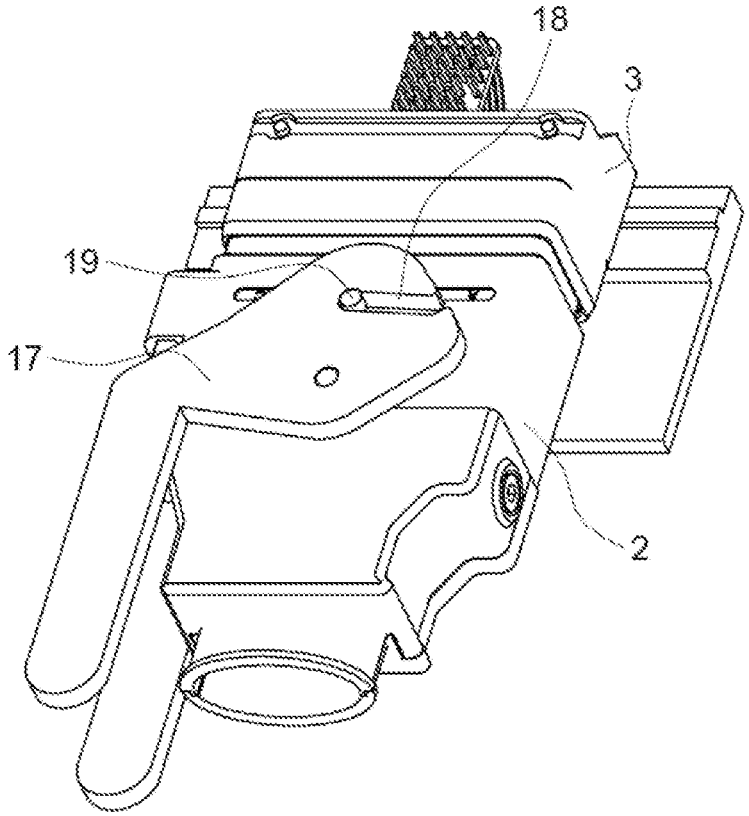
FIG. 9 illustrates a third embodiment of the connector of FIGS. 1 to 7.

According to a third embodiment shown in FIG. 9, compatible with the embodiments of FIGS. 1 to 7 and FIG. 8, each plate 12 and 17 is equipped with a stem 14, each having a free end.

Note however that it is not beyond the scope of the invention when the plates or each plate are/is pivotally mounted on the base and receives a pin carried by the mobile part.

Furthermore, in various contemplated embodiments, the driver, and particularly the first and second parts can be metallised, i.e. coated with a metallic layer to provide protection against electromagnetic interference.

The embodiments of the invention in which an exclusive property or privilege is claimed are defined as follows:

1. A lever-type connector, comprising a first part forming a base and a second part mobile in relation to the base, the first and second parts inwardly receiving first and second sets of contacts facing one another, male and female respectively, each provided at one end with conductors to be connected, and a cam mechanism adapted to move the mobile part between a first complete disconnection position of the first and second sets of contacts and a second active electrical contact position of the first and second sets of contacts, the cam mechanism having a lever shaped so as not to extend laterally beyond a perimeter of the first part and second part, wherein the lever comprises:

a plate pivotally mounted on an outer surface of a lateral face of the mobile part and having at least one slot into which a pin engages directly, the pin extending laterally from an inner surface of a lateral face of the base so that when the mobile part is inserted into the base, the lever is inserted between the mobile part and the base, and a stem extending from the plate, the stem not extending laterally beyond the perimeter of the first part and second part in the first position of the mobile part, wherein the stem extends perpendicularly to the at least one slot and in a coupling direction when the lever is in the second position.

2. The connector according to claim 1, wherein the lever has a second plate pivotally mounted on a second lateral outer face of the mobile part and comprising a slot in which a pin, provided on a second lateral inner face of the base, engages, the second plate being linked to the stem.

3. The connector according to claim 2, comprising a second stem extending from the second plate.

4. The connector according to claim 1, wherein the plate comprises a single lateral slot.

5. The connector according to claim 1, wherein the plate comprises two lateral slots, the two slots both being able to absorb connection forces between the base and the mobile part.

6. The connector according to claim 5, wherein a first slot of the two slots is curved and second slot of the two slots is rectilinear, the two slots extending in two substantially perpendicular directions.

7. The connector according to claim 5, wherein each of the two slots has an end provided with localised constriction for blocking a pin in the active electrical contact position of the first and second sets of contact assemblies.

8. The connector according to claim 1, wherein the cam mechanism is mounted between the lateral faces opposite the plate and the mobile part.

9. The connector according to claim 1, wherein the first and second parts are metallised.

10. A printed circuit board, characterised in that it has a set of lever-type connectors according to claim 1.

* * * * *